US005974298A

United States Patent [19]

Urban et al.

[11] Patent Number: 5,974,298

[45] Date of Patent: Oct. 26, 1999

[54] DUPLEX PRINTING MEDIA HANDLING SYSTEM

[75] Inventors: Carl T. Urban, Portland; Barry G. Mannie, Tualatin, both of Oreg.

[73] Assignee: Tektronix, Inc., Wilsonville, Oreg.

[21] Appl. No.: 09/141,927

[22] Filed: Aug. 28, 1998

[51] Int. Cl.[6] ..... G03G 15/00

[52] U.S. Cl. ..... 399/401; 399/388; 399/390; 399/397; 271/184; 271/225

[58] Field of Search ..... 399/388, 389, 399/390, 397, 401, 405; 347/103, 102, 213, 217; 271/225, 184–186, 902

[56] References Cited

U.S. PATENT DOCUMENTS

| | | | |
|---|---|---|---|
| 4,046,471 | 9/1977 | Branham et al. . | |
| 4,234,180 | 11/1980 | Looney | 271/3.1 |
| 4,272,181 | 6/1981 | Treseder . | |
| 4,334,765 | 6/1982 | Clark . | |
| 4,348,101 | 9/1982 | Schonfeld et al. . | |
| 4,453,841 | 6/1984 | Bobick et al. | 400/126 |
| 4,475,128 | 10/1984 | Koumura | 358/296 |
| 4,879,571 | 11/1989 | Plasscheart | 355/26 |
| 4,881,132 | 11/1989 | Lajos | 358/296 |
| 5,389,958 | 2/1995 | Bui et al. | 347/103 |
| 5,448,348 | 9/1995 | Azeta | 399/364 |
| 5,680,651 | 10/1997 | Tsuji et al. | 399/401 |
| 5,691,756 | 11/1997 | Rise et al. | 347/102 |
| 5,710,586 | 1/1998 | Esplin et al. | 347/103 |
| 5,764,245 | 6/1998 | Yokoi | 347/16 |
| 5,764,263 | 6/1998 | Lin | 347/101 |
| 5,772,343 | 6/1998 | Beretta et al. | 400/624 |
| 5,790,160 | 8/1998 | Reeves et al. | 347/103 X |
| 5,790,766 | 8/1998 | Sakamoto et al. | 395/113 |
| 5,805,191 | 9/1998 | Jones et al. | 347/103 |
| 5,808,645 | 10/1998 | Reeves et al. | 347/103 |
| 5,820,275 | 10/1998 | Crawford et al. | 347/103 X |
| 5,852,764 | 12/1998 | Kida et al. | 399/401 |

*Primary Examiner*—Matthew S. Smith
*Attorney, Agent, or Firm*—Ralph D'Alessandro

[57] ABSTRACT

A media sheet handling system and a method of duplex printing are disclosed wherein a media sheet is imaged with a phase change ink on both sides of the media sheet without smudging or remelting the images and the media sheet is partially exited from the printer into a media output tray and then is drawn back into the printer along a duplex path of travel that automatically reverses the media sheet so that the trailing edge becomes the leading edge during the imaging of the second side of the media sheet. The stiffness of the media sheet facilitates the media sheet moving above and beyond a stationary media path diverter prior to reversing its direction of travel along and passing along the duplex path of travel back to the imaging station.

15 Claims, 5 Drawing Sheets

DUPLEX PRINTING MEDIA HANDLING SYSTEM

BACKGROUND OF THE INVENTION

This invention relates generally to methods and apparatus for printing on two sides of a media sheet, and more particularly, to a media handling system which first feeds a media sheet with a first side exposed to a print source, then feeds the media sheet with a second side exposed to the print source.

Printing to two sides of a media sheet, referred to as duplex printing, is a desirable feature in printing systems, especially in desktop or office color printers as printing speeds increase. The advantages of duplex printing include reducing the amount of paper required compared to one-sided (simplex) printing, and generating print sets with layouts resembling that of professionally printed books. Conventional duplex printing devices employ complex paper handling mechanisms. Typically, an extra tray is used for temporary storage of pages having printing on a first side. In an alternative approach a second paper path is provided to route a first printed page around the existing paper supply. Another approach utilizes a media re-feed guide that positively blocks the movement of media along a first path of travel and directs the media travel along a second path.

Similarly, duplex copying typically is accomplished by either one of two methods. In one method, first side copies are stacked in a duplex tray. When a set of first side copies is complete, the copies are fed out of the duplex tray and returned with an odd number of inversions along a duplex path to receive second side imaging. In an alternative method first side copies are returned directly to receive second side imaging without stacking.

The development of new technologies to accomplish color office printing, such as solid or phase change ink printing has presented special problems to be overcome if successful duplex printing is to be achieved. Solid ink printing employs a wax-like ink base that is jetted at a molten temperature and then solidifies as it cools on intermediate and final receiving substrates. Printing on the second side of a media sheet without melting or destroying the hardened image on the first side has been a barrier to duplex printing. Paper curling has also been a problem.

Conventional devices to achieve duplex printing tend to have long paper paths, multiple imaging units, and many parts. It is desirable to achieve a simplified method and apparatus for duplex media handling at a desktop printer. These problems are solved in the design of the present invention.

SUMMARY OF THE INVENTION

It is an aspect of the present invention that a simple desktop printer duplexing method and apparatus are provided to achieve duplex printing.

It is another aspect of the present invention that the simple duplex printing apparatus and method are usable with solid or phase change ink.

It is yet another aspect of the present invention that a passive media path diverter is utilized to change the media path from a simplex to a duplex path to achieve duplex printing when desired.

It is a feature of the present invention that the angle of the axis of the exit rollers from the vertical combines with the media stiffness and entrance angle of the duplex path to snap the trail end of the media above the passive media path diverter onto the duplex media path prior to reversing the direction of travel of the media to initiate duplex printing.

It is another feature of the present invention that the single image side of the media partially exits the printer into the output tray and then is reversed and drawn back into the duplex media path for imaging on the second side to complete the duplex printing.

It is another feature of the present invention that the reversed media path utilized to accomplish the duplex printing automatically presents the reverse or second side of the media for imaging without necessitating an active media flipping step or apparatus.

It is still another feature of the present invention that sensors track the travel of the media about the media paths during the media travel from simplex to duplex printing.

It is an advantage of the present invention that the apparatus and method are relatively simple and low in cost, but still enable high speed desktop duplex printing to be accomplished.

It is another advantage of the present invention that there is no need for an extra media tray or media storage location to accomplish the duplex printing.

It is still another advantage of the present invention that the duplex printing method and apparatus does not melt or offset or otherwise degrade the solid ink first side image while accomplishing the second side imaging in an offset or indirect printing system.

These and other aspects, features and advantages are achieved in a duplex printing system utilized in an offset solid ink desktop printer to accomplish rapid, low cost, and high quality duplex printing.

BRIEF DESCRIPTION OF THE DRAWINGS

These and other aspects, features and advantages of the invention will become apparent upon consideration of the following detailed disclosure of the invention, especially when it is taken in conjunction with the accompanying drawings wherein.

DETAILED DESCRIPTION OF THE PREFERRED EMBODIMENT

Figure 1:
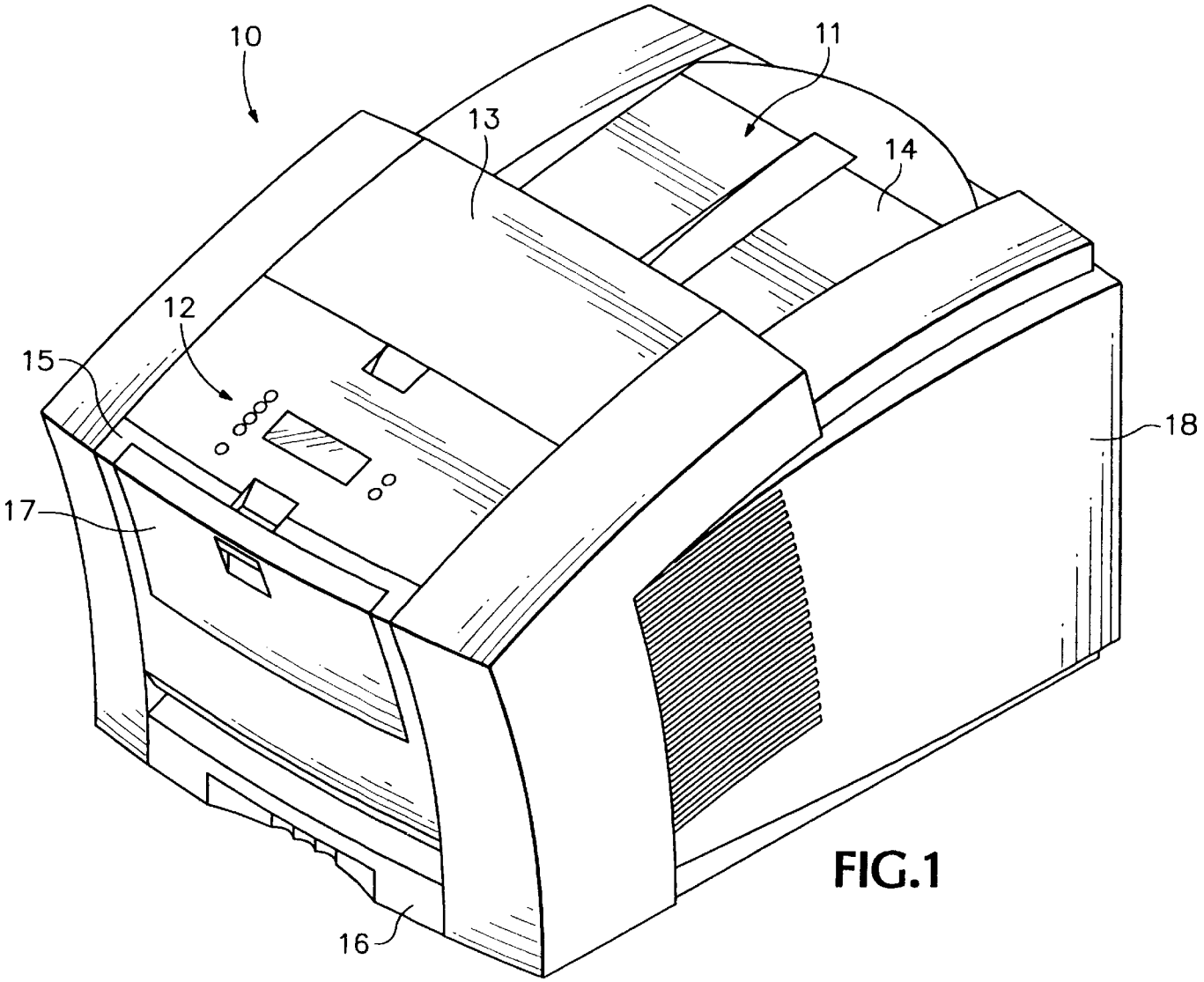
FIG. 1 is a front perspective view of the desktop printer utilizing the present invention.

FIG. 1 shows a desktop printer indicated generally by the numeral 10 which has a media output area 11 for receiving and holding a plurality of completed image outputs. An operator front panel permitting the operator to select certain operating features and to obtain feedback information as indicated generally by the numeral 12 mounted on an ink loader access cover 14 which permits replenishment of solid ink sticks while the printer is operating. A media path access cover 15 is hingedly affixed to the front of the printer 10 to permit access to the paper path and viewing of the media handling apparatus while a hand feed access door 17 is lowerable from cover 15 to permit hand feeding of selected media. A removable media tray 16 is positioned beneath the access cover 15 to provide the desired media for imaging to the printer. Side 18 of the printer is shown having air vents to permit air circulation to flow through the printer.

Figure 2:
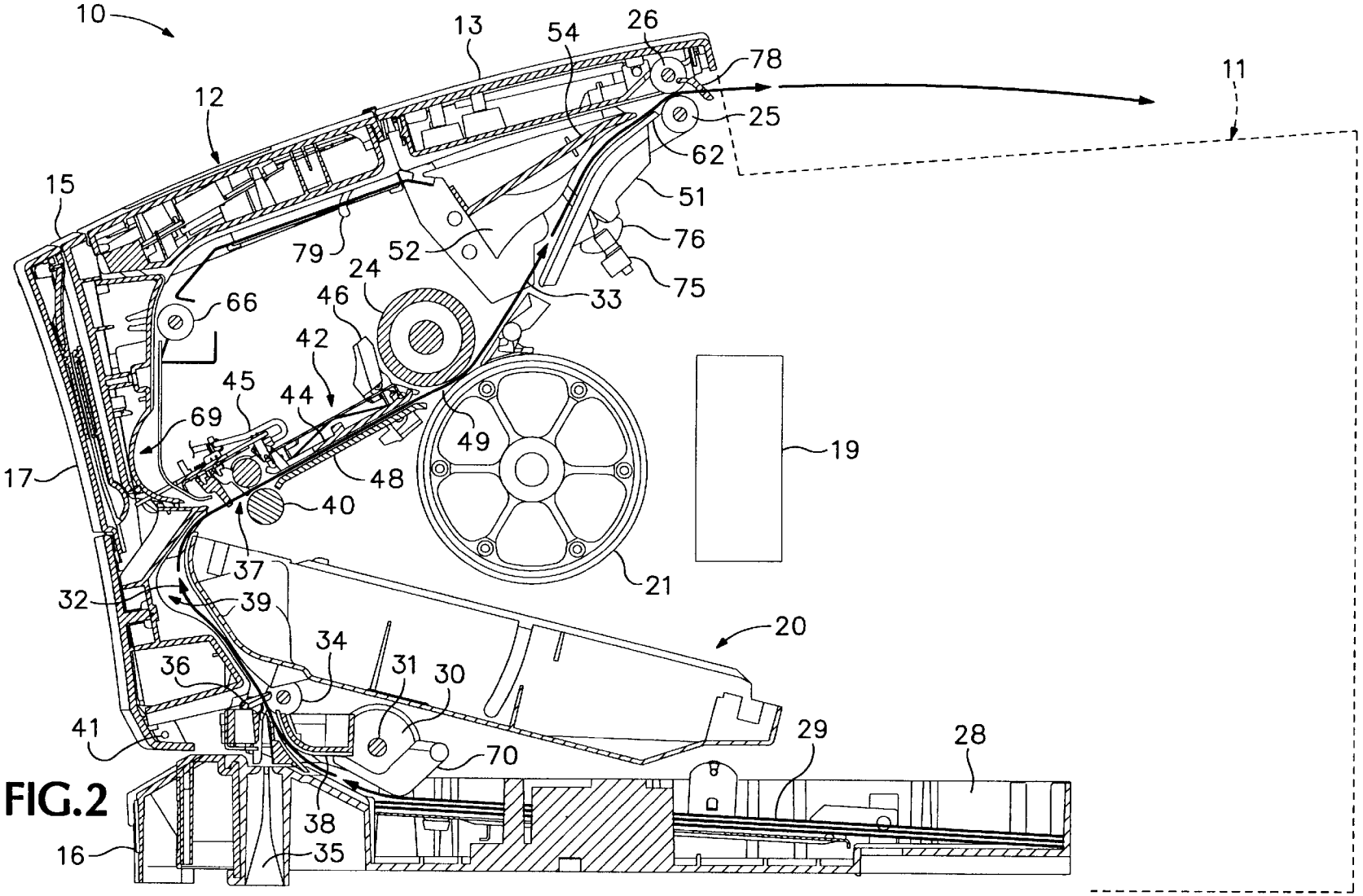
FIG. 2 is a partial side sectional view of the media handling apparatus of the desktop printer of FIG. 1 diagrammatically illustrating a portion of the printer and the media output receiving area.

Looking now at FIG. 2, there are shown in an enlarged partial side sectional view the operative parts of the printer 10 which are employed in transporting and imaging a media sheet as it passes through the printer. Diagrammatically illustrated is the media output area 11 and print head 19. Print head 19 applies molten phase change colored ink to a liquid intermediate transfer surface that is applied by an appropriate contact surface, such as a wick or web (not shown) contained within the drum maintenance unit, indicated generally by the numeral 20, to the arcuate support surface of a rotatable support drum 21. The image present on the liquid intermediate transfer layer on drum 21 is contact transferred to the media sheet 29 and then fused by the combination of heat and pressure applied between drum 21 and transfer and fusing roller 24 to complete the offset or indirect imaging process prior to the imaged media sheet 29 passing through the exit rollers 25 and 26, only one of each of which are shown, into the media output area 11. The indirect printing process employed in the printer utilizing the present invention is described in greater detail in U.S. Pat. No. 5,389,958 entitled "Imaging Process", issued Feb. 14, 1995; the print head 19 utilized in the printer employing the present invention is representative of that described in greater detail in U.S. Pat. No. 5,635,964 entitled "Ink-Jet Print Head Having Improved Thermal Uniformity", issued Jun. 3, 1997; and the drum maintenance unit 20 is described in further detail in U.S. Pat. No. 5,808,645 entitled "Removable Applicator Assembly For Applying A Liquid Layer", issued Sep. 15, 1998; and co-pending application Ser. No. 08/961,813 entitled "Replaceable Transfer Surface Assembly", filed Oct. 31, 1997, all assigned to the assignee of the present invention which are hereby specifically incorporated by reference in pertinent part.

FIG. 2 shows individual sheets of print media 29 contained in the media supply tray receptacle 28 and a print media pick function that employs a pick roller 30 which picks a single sheet 29 of print medium from the media supply tray receptacle 28 by a single rotation of the shaft 31 which can be driven by any appropriate means, such as a flapper solenoid (not shown). The print media sheet 29 is drawn along a first simplex paper path, indicated by the arrow 32, by lower transport rollers 34, only one of which is shown in FIG. 2.

FIG. 2 also shows a media auxiliary tray feed chute 35 that delivers sheets of media from an auxiliary tray (not shown) which optionally can be utilized beneath printer 10. Feed chute 35 delivers the print media into the simplex media path 32 via appropriate paper pick and transport means and into contact with the lower transport rollers 34. A media guide and idler roller support 36 is shown cooperative with the one illustrated lower transport roller 34 to help guide media along path 32. Media sheets 29 coming out of media supply tray receptacle 28 also are guided along their path by the media guide surface 38 located intermediate the pick roller 30 and the lower transport roller 34. As the media sheets 29 are driven and guided through the simplex media path 32, they pass through a simplex buckle deskew area 39 that permits the individual media sheets 29 to align themselves correctly prior to passing into the nip, indicated generally by the numeral 37, formed by the upper transport rollers 40. A series of flexible guide fingers (not shown) are employed in the simplex buckle deskew area 39, which is located in the hingedly mounted media path access cover 15 that pivots about door pin 41. Media sheets 29 continue progressing from the simplex media path 32 to the media path 33 common to both simplex and duplex printing through the upper transport rollers 40 into the media preheater assembly indicated generally by the numeral 42.

Figure 7:
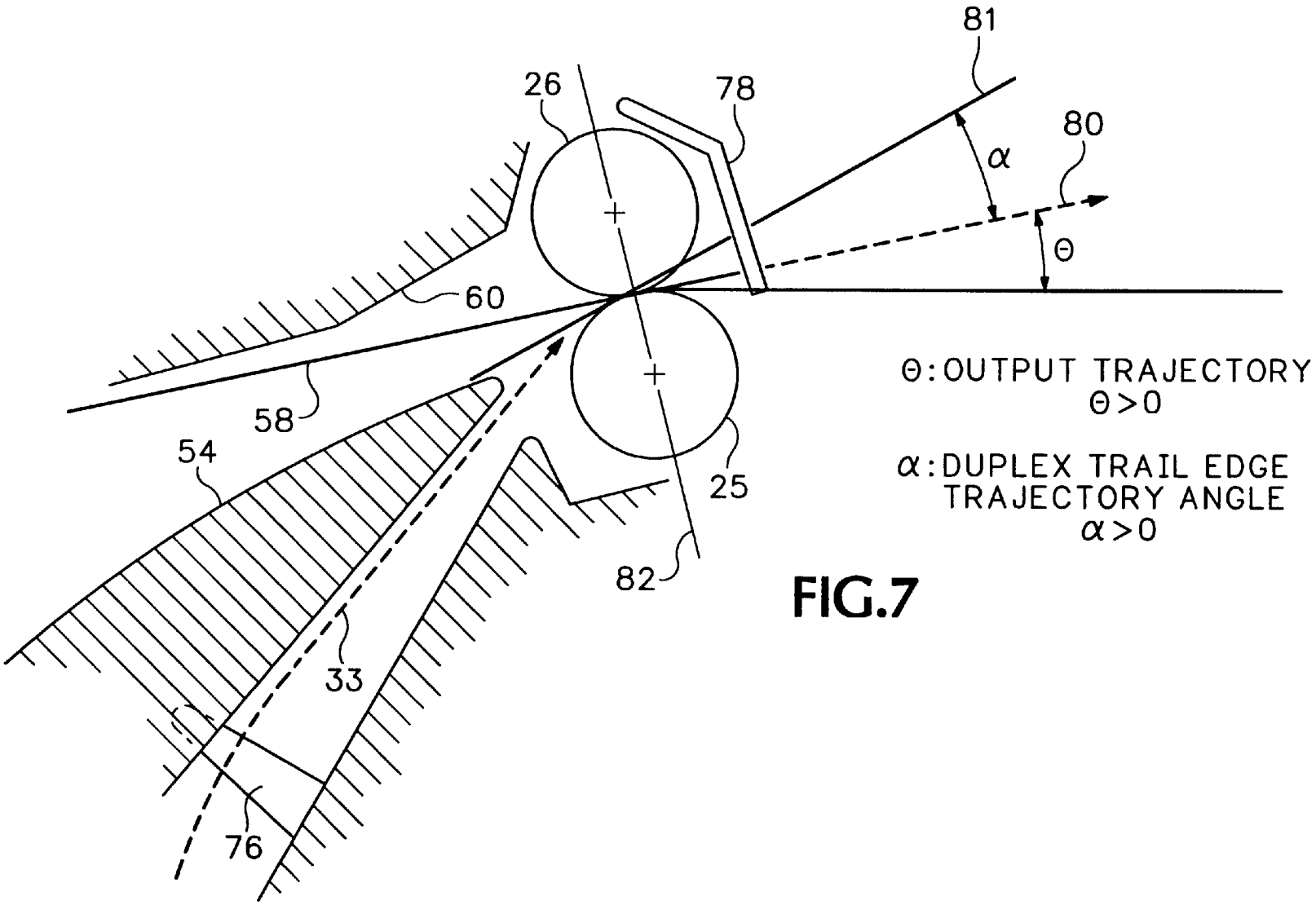
FIG. 7 is a diagrammatic illustration of the relationship of the positioning of the axes of the exit rollers and the tangent lines of the duplex media sheet path and of the top surface of the passive media path diverter.

Preheater assembly 42 includes a media preheater plate 44 that is made from electroless nickel plated aluminum and which is connected via an electrical connecting cable 45 to a circuit board 43 that controls the resistance heating elements used to heat the preheater plate 44 to the desired temperature. The media preheater assembly 42 also includes a preheater sensor body and bracket 46, partially shown. A preheater assembly media guide plate 48 underlies the media path and the heater plate 44 to support media sheets 29 passing thereover into the transfer and fixing nip 49 formed between the support drum 21 and the transfer and fusing roller 24, at which location the contact transfer to the media sheet 29 of the image applied by print head 19 to the liquid intermediate transfer layer on the surface of support drum 21 is accomplished. Following the contact transfer of the image, a stripper finger contact assembly 50 strips the media sheet 29 from the surface of drum 21 and continues to guide it upwardly onto the hinged media guide 51 with a plurality of guide ribs 62 (only one of which is shown) which underlie the media outer strip guide surfaces 52 (again only one of which is shown). The media sheet 29 continues passing upwardly beneath the stationary or passive media path diverter 54 into the exit rollers 25 and 26 whose axes, when connected by a straight line 82 as seen in FIG. 7, are offset from the vertical to facilitate both directing the trailing edge 27 of media sheet 29 back into the printer 10 above the tip 55 of passive media path diverter 54 and proper stacking of printed media sheets 29 in the output area 11. As seen in FIG. 7, the tangent line 80 for the duplex media path 58 is above the tangent line 81 of the top surface of the passive media path diverter 54.

Figures 3, 4:
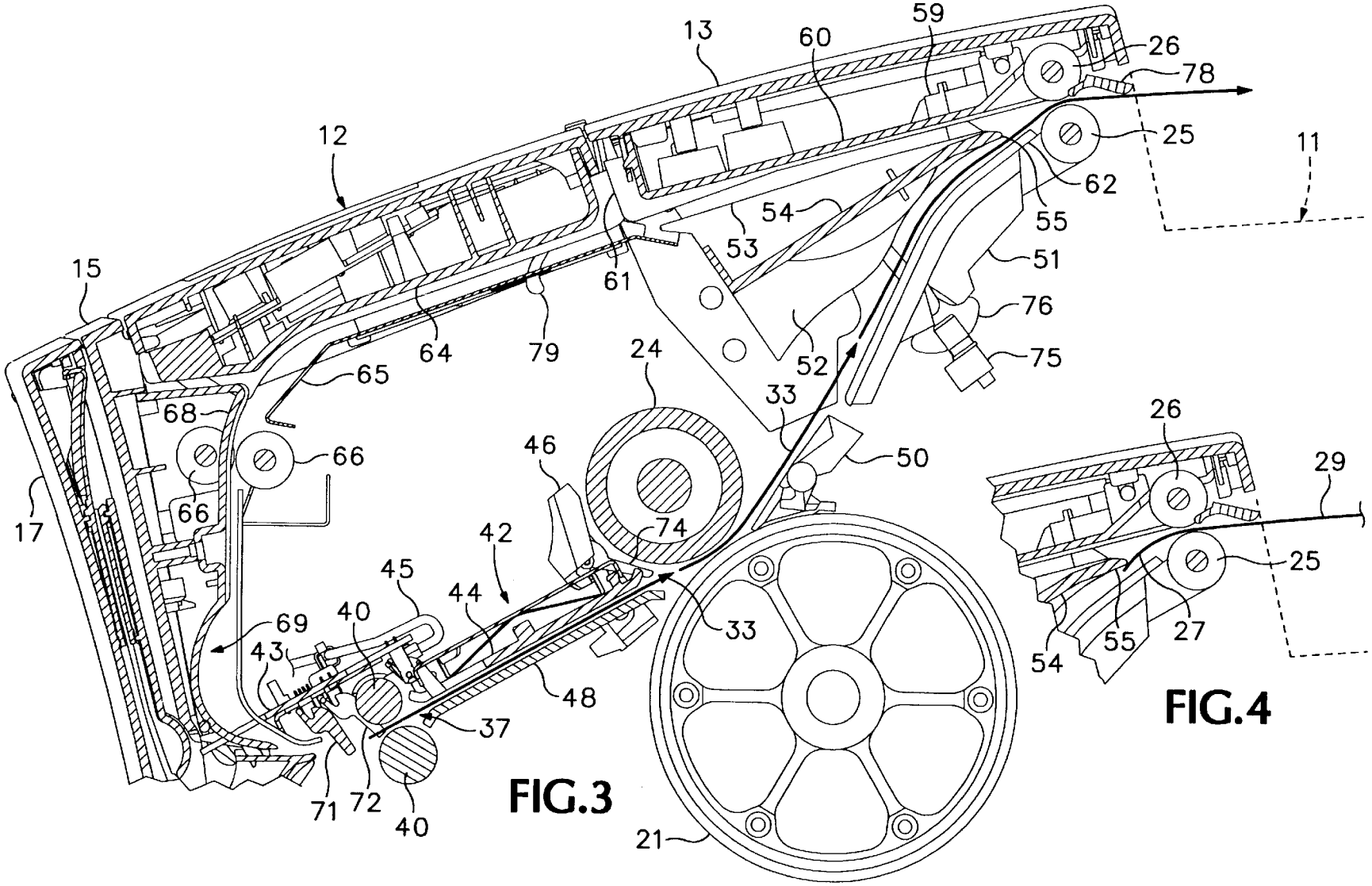
FIG. 3 is an enlarged partial sectional view of a portion of the simplex media printing path followed in the media handling apparatus of FIG. 2.
FIG. 4 is an enlarged partial side sectional view of the passive media path diverter and reversible exit rollers diagrammatically illustrating a simplex or single side imaged media about to partially exit the printer and reverse its path of travel into the duplex media imaging path.
Figures 5, 6:
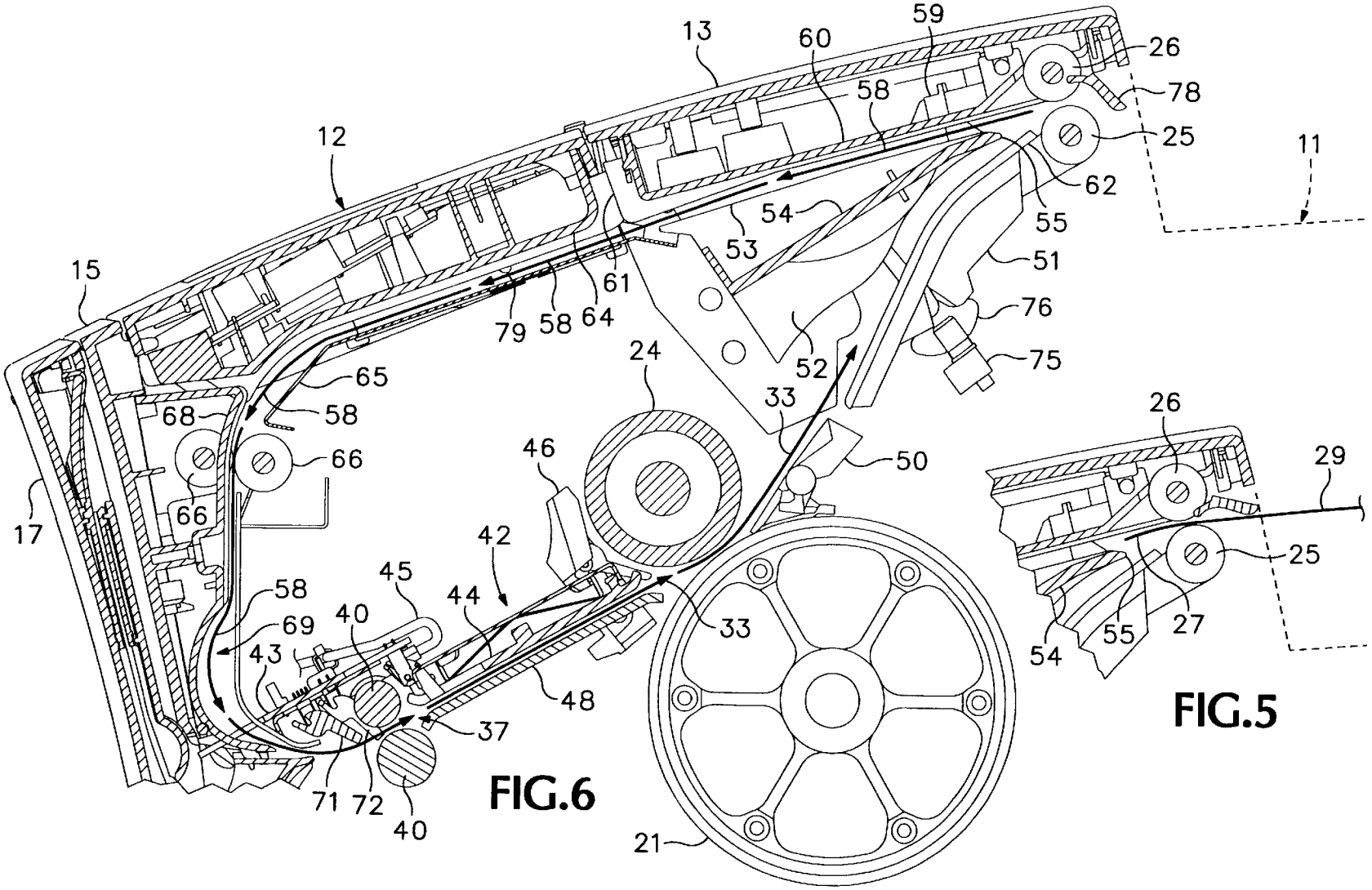
FIG. 5 is an enlarged partial side sectional view of the passive media path diverter and exit roller apparatus of FIG. 3 showing the media reversing its path of direction and having used the stiffness of the media and entrance angle of the duplex path to snap the trail end above the passive media path diverter and commence its travel along the duplex media printing path.
FIG. 6 is an enlarged partial side sectional view of the duplex media path of travel along the media handling apparatus of FIG. 2.

The media sheet 29 passes out between the exit rollers 25 and 26 in simplex printing all the way into the media output area 11. When duplex printing is selected, the printer controller (not shown) signals the printer to reverse the driven roller 25 when the media sheet 29 has progressed sufficiently passed the tip 55 of the passive media path diverter 54, as shown between FIGS. 4 and 5. FIG. 4 shows the media sheet 29 as it is just about to complete its forward progress into the output area 11 with the trailing edge 27 of media sheet 29 still retained just at the tip 55 of the passive media path diverter 54. FIG. 5 shows the trailing edge 27 having been advanced forwardly of the tip 55 of the passive media path diverter 54, so that the combination of the stiffness of the media and the positioning of the exit rollers 25 and 26 have combined to snap or raise the trailing edge 27 of the media sheet 29 above and beyond the passive media path diverter 54. Upon signal, the printer controller (not shown) reverses the direction of rotation of the driven exit roller 25 to draw the media sheet 29 back into the printer and into the duplex media path indicated by the arrow 58, best seen in FIG. 6. The media sheet 29 is partially exited from the printer 10 into a media output area 11 and then is drawn back into the printer along the duplex path of travel 58 that automatically reverses the media sheet 29 so that the trailing edge 27 of the media sheet 29 becomes the leading edge during the imaging of the second side of the media sheet 29.

Media sheet 29 is conveyed along duplex media path 58 by the exit rollers 25 and 26 which are biased by springs (not shown) retained in place on roller biasing supports 59 (only one of which is shown) within the assembly that includes upper media path access cover 13. The upper portion 53 of guide surface 52 and the duplex upper media guide 60 define the pathway between which media sheet 29 is passed along the duplex media path 58. Upper media guide 60 also has guide ribs 61 (only one of which is shown) and is a molded portion of the pivotable assembly that includes access cover 13. Plastic cover supports 62 supply support for the upper media guides 60 in the plastic molded cover 13. Similarly, the cover assembly with display 12 has plastic molded supporting structure 64 which acts as a media guide along the upper surface of duplex media path 58. A nickel plated steel plate 65 serves as a guide for the bottom portion of the duplex media path 58 beneath the cover assembly in which display 12 is found.

Once the media sheet 29 advances along duplex media path 58 to where its leading edge enters the nip formed by the duplex transport rollers 66, plastic molded guides 68 in access cover 15 direct the media sheet 29 into the duplex buckle deskew area 69. In combination with flexible guide fingers (not shown) and the upper transport rollers 40, media sheet 29 is buckled within the buckle deskew area 69 to permit the individual media sheets 29 to become properly aligned and then proceed through upper transport rollers 40 along the common media path 33 through the media preheater assembly 42 and through the transfer and fusing nip 49 previously described. The media sheet 29 receives the image applied from the print head 19 to the liquid intermediate transfer layer on the surface of support drum 21 and then is conveyed upwardly beneath the stationary or passive media path diverter 54 and out through the exit rollers 25 and 26 where the duplex imaged media sheet 29 is deposited in the media output area 11, best seen in FIG. 2.

A series of sensors track the progress of media sheets 29 about the media paths 32, 33 and 58, depending upon the selected printing mode. All of the sensors provide feedback into the printer controller (not shown) to track the status of the media sheet 29 within the printer 10. Sensors employed at various locations throughout the paper paths 32, 33 and 58 are typically OJ series opto sensors available from Aleph International of San Fernando, Calif., which utilize a pivotable sensing flag within a sensing field established by the sensor. The initial flag encountered is the tray empty flag 70 seen in FIG. 2 that will indicate when the supply of media sheets 29 needs to be replenished. A pair of sensors adjacent the nip formed by the upper transport rollers 40 signal the arrival of the media at the nip and the size of the media sheet by the movement of left edge flag 71 and A-size media sheet detector flag 72, respectively. Once the media sheet 29 has exited the preheater assembly 42, its progress is noted by movement of the preheater exit flag 74. Continuing along the common media path 33, the opto sensor 75 with its stripper flag 76 indicates that the media sheet 29 has been successfully stripped from the transport and fusing roller 24 and continues along its path toward the exit rollers 25 and 26. Once the media sheet 29 passes through the nip between exit rollers 25 and 26, it hits the exit flag and full output tray sensor 78 which provides the dual purpose of monitoring the progress of the media sheet 29 through the exit rollers, as well as alerting the printer operator that the output area 11 is full of imaged media sheets and needs to be emptied, as appropriate. When duplex printing is employed, the media sheet 29 recommences its travel along duplex media path 58 and reenters the printer engaging duplex flag 79 in the display cover 12, best seen in FIGS. 2 and 3 in the lowered position, to indicate successful reentry of the media sheet 29 into the printer and progress along the duplex media path 58. Finally, the media sheet 29, after passing through the upper transport rollers 66, passes into and through the buckle deskew area 69 and reengages the left edge detector flag 71 to recommence its transport along the common media path 33 and retracking of its progress by sensor flags 72, 74, 76 and 78, and their related sensors, as previously described, until the duplexed image sheet is deposited into the output area 11.

Key to being able to duplex image a media sheet 29 in the solid ink printer 10 is the control of the temperature of the media sheet 29 and the various heating apparatus after the simplex imaging has occurred with the placement of molten ink on the liquid intermediate transfer layer on the surface of support drum 21 and its contact transfer in a malleable state to the media sheet 29 in the transfer and fusing nip 49. The transferred image continues to cool and harden into a ductile state on the one side of the image media sheet 29 and then media sheet 29 is recommended along its duplex media path 58 by the reversing of the upper transport rollers 25 and 26. To avoid remelting or smudging the simplex imaged side of the media sheet 29, the temperature of the media preheater and the transfer and fusing drum 24 must be controlled so that the temperature is not elevated sufficiently high to remelt the hardened image on the first side of the media sheet 29. Prior phase change ink printers operated the preheat apparatus 42 and the transfer and fusing roller 24 such that the temperature was approximately 90° C. in this area. In the present invention, the preheat and fusing temperatures are kept below 70° C., preferably between about 55° and 65° C., and most preferably at about 60° C. This temperature range provides sufficient heat to elevate the temperature of the image receiving medium, transfer and fuse the malleable image from the liquid intermediate transfer layer on the surface of support drum 21 onto the media sheet 29 to have successful imaging both in simplex and duplex printing and still avoid remelting or smudging the first side or simplex imaged media sheet 29 during the duplex imaging step. The imaged first side of the media sheet is not affected during the duplex imaging step.

In operation, the printer 10 has the pick roller 30 pick a media sheet 29 from the media supply tray receptacle 28 in the removable media tray 16 and start along the media path 32 by directing the sheet 29 into the lower transport rollers 34. Transport rollers 34 continue guiding the sheet forward along simplex media path 32 into the simplex buckle deskew area 39 where the media sheet 29, in cooperation with media guide fingers (not shown), is aligned prior to entry into the nip form by the upper transport rollers 40. The fingers both guide and provide a spring force unaffected by humidity that presses the lead edge into the stalled rollers, thus aligning the single media sheet prior to printing. A left edge detector flag 71 and A-size media detector flag 72 sense the media sheet 29 as it enters the transport rollers 40.

The media preheater assembly 42 utilizes resistance heaters controlled by a circuit board 43 to heat the media between the preheater guide plate 48 and the heater plate 44 to the appropriate temperature so that the media sheet upon passing therethrough achieves a temperature which is approximately 60° C. Passing out of the media preheater assembly 42, the media sheet 29 actuates the preheater exit flag 74 to signal that the media sheet 29 is about to enter the transfer and fusing nip 49 where image transfer takes place from the liquid intermediate transfer layer on the surface of support drum 21 where the print head 19 has ejected the molten image that is now in a malleable state.

The simplex image media sheet 29 is stripped from the support drum 21 by the stripper finger contact assembly 50 and continues along the common media path 33 where stripper flag 76 detects successful exiting from the nip 49. The media sheet 29 continues to travel up to the upper transport rollers 25 and 26 where the sensor activated by exit flag 78 signals the printer controller that the media sheet 29 is exiting the exit rollers 25 and 26 into the media output area 11. If simplex printing is the selected imaging technique, the media sheet 29 is deposited into the media output area 11 along the path indicated generally by the arrows in FIG. 2.

Where duplex imaging is the technique that has been selected, the exit rollers 25 and 26 are stopped and the driven exit roller 25 is reversed to draw the simplex imaged media sheet 29 back into the printer along the duplex media path 58. The trailing edge 27 of the media sheet, prior to being drawn back into the printer 10, has passed beyond the tip 55 of passive media diverter 54 and, in combination with the stiffness of the media sheet and the positioning of the upper transport rollers 25 and 26, is snapped up above and beyond the tip 55 so that upon reversal of motion, the media sheet 29 follows the duplex media path 58. Upper transport rollers 25 and 26 direct the simplex imaged media sheet 29 along the duplex media path 58 between the duplex upper media guides 60, the supporting structure 64, and the plate 65 as it moves toward the duplex transport rollers 66. Enroute along the duplex media path 58 and prior to entering the duplex transport rollers 66, the duplex path sensor is signaled by movement of flag 79 to control movement of the media sheet 29 through the final stages of its movement back into the common media path 33.

Prior to entering the common media path 33, the duplex transport rollers 66 deliver the media sheet 29 into the duplex buckle deskew area which, similarly to the simplex buckle deskew area 39, aligns the media sheet 29 with the aid of the flexible guide fingers (not shown) prior to entry into the upper transport rollers 40. Again the left edge detector flag 71 and the A-size media detector flag 72 are activated as the media sheet passes through the upper transport rollers into the preheater assembly 42 where the simplex imaged media sheet 29 is heated to the temperature of approximately 60° so as to preheat the media, but not remelt or cause smudging of the simplex image.

The exit from the media preheater 42 is continued as described earlier along the common media path 33 and the imaging of the second side of the media sheet 29 in the duplex imaging process is accomplished in like manner as previously described. The then duplex imaged media sheet 29 is transported upwardly along common media path 33 into the exit rollers 25 and 26 and the duplex imaged sheet 29 is ejected from the printer 10 into the media output area 11.

While the invention has been described above with references to specific embodiments thereof, it is apparent that many changes, modifications and variations in the materials, arrangements of parts and steps can be made without departing from the inventive concept disclosed herein. Accordingly, the spirit and broad scope of the appended claims is intended to embrace all such changes, modifications and variations that may occur to one of skill in the art upon a reading of the disclosure. All patent applications, patents and other publications cited herein are incorporated by reference in their entirety.

Having thus described the invention, what is claimed is:

1. A media sheet handling method for printing on two sides of a media sheet comprising the steps of:

removing the media sheet from a storage tray and directing it into a first path of travel in a printer;

passing the media sheet through at least a first set of transport means and through a media preheater along a second common path of travel to heat the media to a desired temperature prior to imaging;

passing the media sheet through an imaging station to image a first side of the media sheet;

passing the first side imaged media sheet partially through a set of exit transport means so that the media sheet partially exits the printer into a media output area and a trailing edge of the media sheet passes under and then moves beyond and above a stationary media path diverter;

reversing the direction of movement of the set of exit transport means so that the media sheet reenters the printer and passes along a third path of travel above the stationary media path diverter;

passing the media sheet from the third path of travel back through the media preheater along the second common path of travel to heat the media sheet to the desired temperature prior to imaging without affecting the imaged first side of the media sheet;

passing the media sheet through the imaging station to image a second side of the media sheet without affecting the imaged first side of the media sheet; and passing the media sheet through the set of exit transport means so that the media sheet exits the printer into the media output area.

2. The method according to claim 1 wherein the method of printing is using a phase change ink and a printer which first melts solid phase change ink and then ejects it from a print head onto a receiving surface.

3. The method according to claim 2 wherein the step of heating the media sheet to the desired temperature by passing the media sheet through the media preheater comprises heating the media to about 55° to about 65° Centigrade.

4. The method according to claim 3 wherein the steps of imaging the media sheet comprises offset printing by transferring a phase change ink image from a first intermediate transfer surface to a final receiving surface on the first side and the second side of the media sheet.

5. The method according to claim 4 wherein the steps of passing the media sheet through at least the first set of transport means and the set of exit transport means comprises passing the media sheet through at least a first set of transport rollers and a set of exit transport rollers.

6. The method according to claim 4 wherein the steps of passing the media sheet through the imaging station comprises applying a liquid intermediate transfer layer to a support surface prior to applying a phase change image to the first intermediate transfer surface.

7. The method according to claim 1 wherein the step of reversing the direction of movement of the set of exit transport means so that the media sheet reenters the printer and passes along the third path of travel comprises passing the media sheet along a tangent line to the third path of travel that is above a tangent line to a top surface of the stationary media path diverter.

8. A media sheet handling apparatus for a printer having an imaging station for imaging a media sheet on two sides comprising:

media sheet storage means for storing a plurality of sheets of media to be imaged by the printer;

a first path of travel along which a media sheet travels in the printer en route to the imaging station;

pick means to remove a media sheet from the media storage means and direct it to the first path of travel;

first transport means to direct movement of the media sheet in the printer and along the first path of travel to a second common path of travel through the imaging station to image the media sheet on a first side;

reversible exit transport means movable in a first direction of travel to move the first side imaged media sheet at least partially from the printer into an imaged output area;

a stationary media path diverter in the second common path of travel between the imaging station and the reversible exit transport means such that, when the reversible exit transport means moves the first side imaged media sheet at least partially from the printer into the image output area, a trailing edge of the first side imaged media sheet is moved past and above a tip of the stationary media path diverter;

control means to stop the reversible exit transport means and reverse the direction of travel to withdraw the first side imaged media sheet from the imaged output area and draw the first side imaged media sheet back into the printer along a third duplex path of travel above the tip of the stationary media path diverter; and third duplex transport means to move the first side imaged media sheet along the third duplex path of travel and direct the first side imaged media sheet back into the second common path of travel and through the imaging station where the media sheet is imaged on a second side to produce a duplex imaged media sheet that is exited from the printer to the imaged media output area by the exit transport means.

9. The media sheet handling apparatus according to claim 8 further comprising a media preheater positioned along the second common path of travel before the imaging station to heat the media sheet to a desired temperature.

10. The media sheet handling apparatus according to claim 9 further comprising the imaging station including a phase change ink print head to eject molten phase change ink onto a receiving substrate to form an image.

11. The media sheet handling apparatus according to claim 10 further comprising the receiving substrate being an intermediate transfer layer from which the image is contact transferred to the media sheet in an offset printing operation.

12. The media sheet handling apparatus according to claim 11 further comprising the media preheater heating the media sheet to a temperature of between about 55° C. and 65° C. prior to imaging by the print head.

13. The media sheet handling apparatus according to claim 11 further comprising the imaging station including a transfer and fusing roller that presses the media sheet into contact with the phase change ink image on the intermediate transfer layer to effect a contact transfer and fusing of the phase change ink image to the media sheet.

14. The media sheet handling apparatus according to claim 11 further comprising the intermediate transfer layer being a liquid layer supported by an arcuate surface of a support drum.

15. The media sheet handling apparatus according to claim 9 further comprising the first transport means, the third duplex transport means, and the reversible exit transport means being pairs of rollers forming nips between each pair of rollers.

* * * * *